US008073162B2

(12) United States Patent
Ando

(10) Patent No.: US 8,073,162 B2
(45) Date of Patent: Dec. 6, 2011

(54) SPEAKER

(75) Inventor: Yukihiro Ando, Nagano (JP)

(73) Assignee: Yukihiro Ando, Nagano (JP)

( * ) Notice: Subject to any disclaimer, the term of this patent is extended or adjusted under 35 U.S.C. 154(b) by 819 days.

(21) Appl. No.: 12/216,550

(22) Filed: Jul. 8, 2008

(65) Prior Publication Data

US 2009/0169047 A1 Jul. 2, 2009

(30) Foreign Application Priority Data

Dec. 26, 2007 (JP) ..... 2007-334459

(51) Int. Cl.
*H04R 25/00* (2006.01)

(52) U.S. Cl. ..... 381/152; 381/396; 381/398; 381/431

(58) Field of Classification Search ..... 381/151, 381/152, 186, 431
See application file for complete search history.

(56) References Cited

U.S. PATENT DOCUMENTS

| | | | | |
|---|---|---|---|---|
| 6,044,159 | A * | 3/2000 | Schmertmann et al. | 381/186 |
| 6,181,799 | B1 * | 1/2001 | Azima et al. | 381/152 |
| 7,103,190 | B2 * | 9/2006 | Johnson et al. | 381/152 |

FOREIGN PATENT DOCUMENTS

| | | | |
|---|---|---|---|
| JP | 2000-350285 | A | 12/2000 |
| JP | 2002-078078 | A | 3/2002 |
| JP | 2005-159409 | A | 6/2005 |
| JP | 2006-197562 | A | 7/2006 |
| JP | 2006-207108 | A | 8/2006 |
| JP | 2006-303821 | A | 11/2006 |
| JP | 2007-166027 | A | 8/2007 |
| JP | 2007-214917 | A | 8/2007 |
| JP | 2007-228557 | A | 9/2007 |

OTHER PUBLICATIONS

Japanese Office Action for Application No. 2007-334459 dated Oct. 27, 2009.

* cited by examiner

*Primary Examiner* — Charles Garber
*Assistant Examiner* — Yasser Abdelaziez
(74) *Attorney, Agent, or Firm* — Rader, Fishman & Grauer PLLC

(57) ABSTRACT

A speaker includes a sound source, a rod-like member whose base end is in contact with the sound source, and a pair of flexible wing members whose ends are attached to the tip of the rod shape member, and whose other ends are free.

23 Claims, 5 Drawing Sheets

SPEAKER

CROSS-REFERENCES TO RELATED APPLICATION

The disclosure of Japanese Patent Application No. 2007-334459, filed Dec. 26, 2007, including its specification, claims and drawings, is incorporated herein by reference in its entirety.

TECHNICAL FIELD

Described herein is a novel speaker which is different from a conventional speaker which converts an electrical signal into an acoustic signal through a mechanical vibration system.

BACKGROUND

In a conventional speaker, a sound propagates in form of a dilatational wave (a sound wave/longitudinal wave), thereby stimulating human's hearing sense. A speaker which is different from such a conventional speaker is disclosed in Japanese Laid Open Patent Nos. 2000-350285, 2006-207108, and 2006-197562.

Japanese Laid Open Patent No. 2000-350285 discloses a speaker having a diaphragm, a support member which supports the diaphragm in a state where internal stress is produced therein, and a sound source connected with the support member.

Japanese Laid Open Patent No. 2006-207108 discloses a receiver, a piezoelectric device which vibrates based on an audio signal received by the receiver, and a helmet with a speaker to which the piezoelectric device is attached. Moreover, a sheet-like speaker to which the piezoelectric device is brought into close contact with a flexible sheet is disclosed.

Japanese Laid Open Patent No. 2006-197562 discloses a speaker having a piezoelectric device which vibrates based on an input signal, and a wave motion radiation unit which is brought into close contact with an oscillating face of the piezoelectric device.

In Japanese Laid Open Patent Nos. 2006-197562 and 2006-207108, physical characteristics of such a speaker, which are different from those of the conventional speaker are described as set forth below.

That is, the speaker uses the wave motion property of sound. Since the sound from the speaker may propagate in the air as a wave motion, energy loss and its attenuation rate are low, as compared with the conventional speaker. The sound quality and a propagation property thereof are excellent.

In addition, from another point of view, the sound from the speaker described above may be deemed to propagate in the air as particles. However, the mechanism of such a physical phenomenon of the speaker is not necessarily clearly explained.

SUMMARY

A novel speaker is described, based on the knowledge of the new physical phenomenon of such a novel speaker which is different from the conventional speaker.

The present speaker includes a sound source, a rod-like member whose base end is in contact with the sound source, and a pair of flexible wing members whose ends are attached to the tip of the rod shape member, and whose other ends are free.

The present speaker is novel in that the property of the sound, propagation of sound, amplification of sound and attenuation of sound, etc. is used, taking into consideration, the existence of a component of a longitudinal wave and that of a traverse wave in sound, as a starting point.

Wing members each of whose material is different from the other (two or more kinds of materials) is prepared, thereby enjoying the differences in the sound quality due to differences of (the quality of) the materials.

Especially, the shape of the wing members is not limited to a quadrangle, a triangle, and a circle. For example, the shape of the wing members may be that of a thing in nature like a leaf or a petal.

In addition, the number of the wing members may be at least two (a pair) or more.

The sound radiation position in the up-and-down directions can be adjusted.

The wing members of the speaker may be rotatably attached to the speaker. That is, it is possible to rotate the wing members so that the direction of sound can also be rotated as if it follows the wing members.

The present speaker is novel and is different from the conventional speaker in that the present speaker uses physical phenomena such as the special feature of sound, propagation of sound, amplification of sound, and the action of attenuation etc.

BRIEF DESCRIPTION OF THE DRAWINGS

Other features and advantages of the present speaker will be apparent from the ensuing description, taken in conjunction with the accompanying drawings, in which.

DESCRIPTION

A description will now be given, referring to embodiments of the present speaker. While the claims are not limited to such embodiments, an appreciation of various aspects of the present speaker is best gained through a discussion of various examples thereof.

Figure 1:
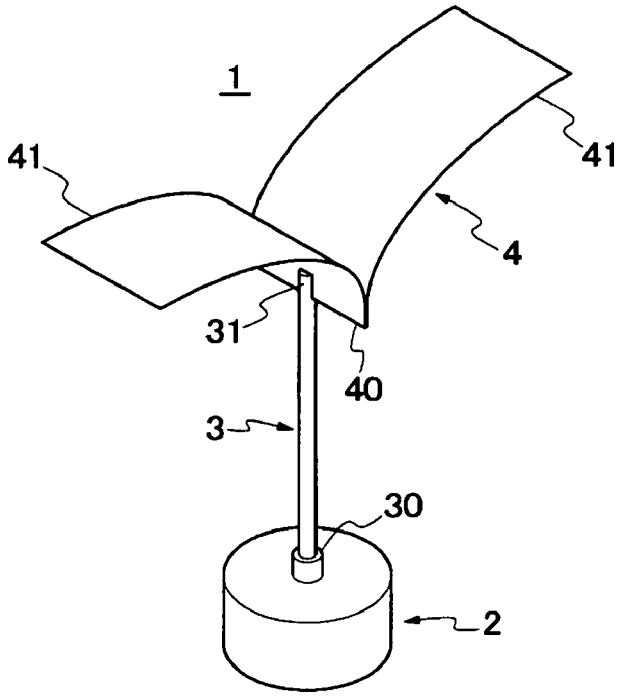
FIG. 1 is a perspective view according to an embodiment of a speaker.
Figure 2:
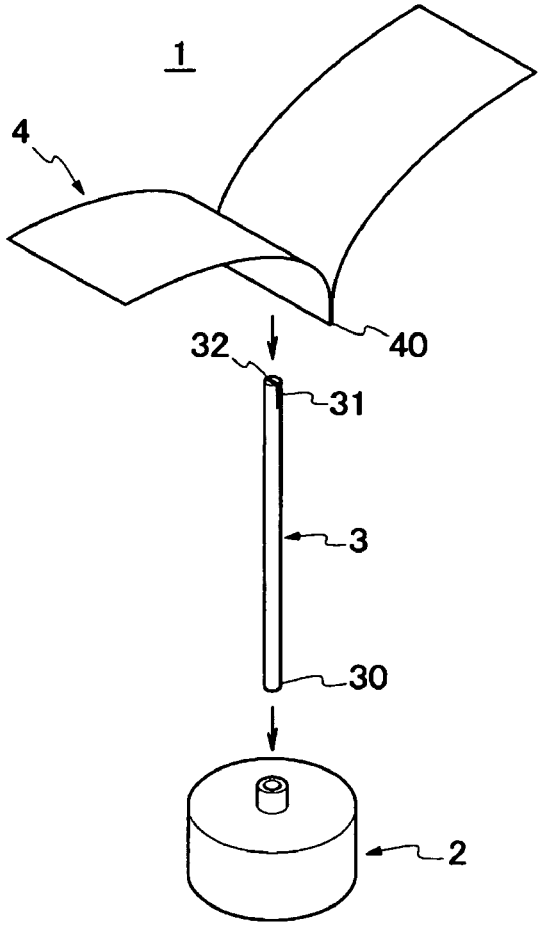
FIG. 2 is an exploded perspective view of a speaker.
Figure 3:
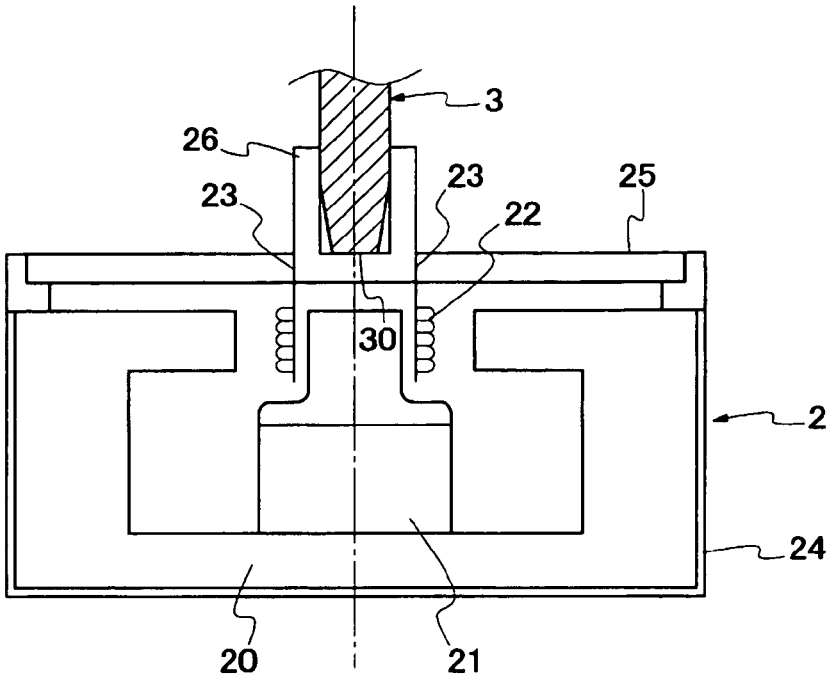
FIG. 3 is a cross sectional view of a sound source of a speaker.
Figure 4:
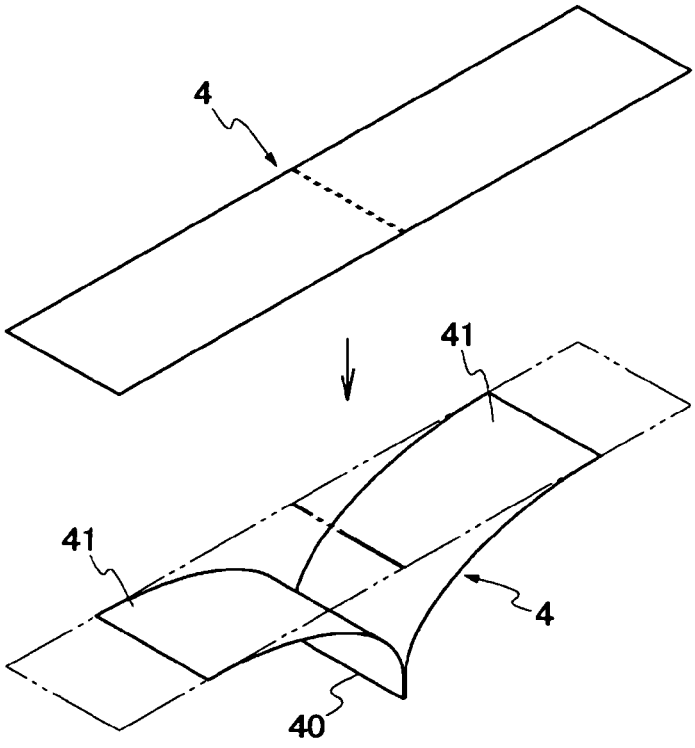
FIG. 4 is an explanatory diagram of wing members of a speaker.

An embodiment of the present speaker is described, referring to drawings. FIG. 1 is a perspective view of the speaker according to an embodiment. FIG. 2 is an exploded view of the speaker. FIG. 3 is a cross-sectional view of a sound source. FIG. 4 is an example of wing members of the speaker. In addition, in each of figures described below, the same numerals are assigned to the same structural elements, respectively, and overlapped explanation thereof is omitted.

As shown in FIGS. 1 and 2, the speaker 1, includes a sound source 2, a rod-like member 3 whose base end 30 is placed in contact with the sound source 2 in a stationary state wherein vibration propagates in the base end 30 from the sound source 2, and a pair of flexible wing members 4 made from paper, in which ends 40 of the respective wing members 4 are attached to a tip 31 of the rod-like member 3, and the other ends of the wing members 4 are free.

As shown in FIG. 3, the sound source 2 includes a yoke 20, a permanent magnet 21 which forms a magnetic field with the yoke 20, a voice coil 22 to which an electrical signal is inputted in the magnetic field, a support section 23 which supports this voice coil 22 in a state where the voice coil 22 is hung in midair, a casing 24 that accommodates the yoke 20, the permanent magnet 21, the voice coil 22, and the support section 23, a lid 25 which closes an opening of the casing 24, and a concave portion 26 to which one end of the support member 23 is attached and into which the base end 30 of the rod-like member 3 is brought into contact.

The lid 25 is made of synthetic resin, such as plastic, and has a hole into which the concave portion 26 can be inserted.

The concave portion 26 is made from wood, plastic, etc., and has a slot to which the base end 30 of the rod-like member 3 is attached.

The sound source 2 differs from the conventional electrodynamic type speaker unit, in that while in the conventional speaker, the diaphragm is attached through a damper, in the present sound sources 2, the lid 25 which is equivalent to the diaphragm is directly attached to the casing 24, and in that while in the conventional sound source, cone paper etc. is used as a diaphragm, in the present sound source 2, hard material such as plastics is used. Since other structural elements are common to each other, any one of an electrodynamic type, electromagnetism type, piezo-electric type, or electrostatic type speaker unit may be used therefor.

The base end 30 of the rod-like member 3 may be placed on the piezoelectric device which can convert an electrical signal into mechanical vibration, as the sound source.

As shown in FIGS. 2 and 3, the base end 30 is inserted in the concave portion 26, and the rod-like member 3 is left at rest. Therefore, the rod-like member 3 is arranged so as to be rotatable by a manual operation with respect to the concave portion 26. An insertion slot 32 for inserting the wing members 4 as shown in FIG. 2 is provided at the tip 31 of the rod-like member 3. As the material of the rod-like member 3, wood, a bamboo, etc. may be desirable but the material is not limited thereto. In addition, it is better that the diameter of the rod-like member 3 is as small as possible.

As shown in FIGS. 1 and 2, the wing members 4 form a pair which is spread to right and left, centering on the insertion slot 32 of the tip 31 of the rod-like member 3. Each wing member is formed approximately in a rectangle shape and each one end 40 thereof is inserted in insertion slot 32 provided in the tip 31 of the rod-like member 3. Since the other ends 41 of the wing members 4 are free, only the one ends 40 should be inserted in the slot 32 and are detachably provided.

Although the ends of two sheets of paper may be inserted in the slot 32 in order to form the wing members 4, one sheet of paper may be prepared as wing members as shown in FIG. 4, and folded at the centerline of the paper sheet, and the centerline portion as one end 40 may be inserted in the slot 32.

The wing members 4 are flexible, and sound (volume) may be emitted in a predetermined bowed state (a stress state as described above). When the bowed state cannot be maintained by the self-weight of the wing members 4, the bowed state can be controlled by attaching a bending force providing member, for example, weight etc., to each edge 41.

The material of the wing members 4 is typically paper, synthetic resin, etc. In addition, styrene foam or hard synthetic resin which is used for packing food may be used for the wing members. Moreover, a concavo-convex emboss pattern may be formed on the front face and/or the back face of the wing members 4, so that stress can also be adjusted.

An operation and effects of the above described speaker will be described below. When an electrical signal is inputted to the voice coil 22 of the sound source 2, a force will be applied to one end of the support section 23 which supports the voice coil 22, based on "the Fleming's left-hand rule."

In FIG. 3, since the one end of the support section 23 is fixed, the kinetic force which tries to move in the up-and-down directions is converted into the vibrational energy which vibrates the lid 25 and the concave portion 26. This vibrational energy is released into the air, thereby serving as a longitudinal wave, and propagating in the air, and this vibrational energy also serves as a traverse wave, and propagates in the air and/or on the surface or inside the rod-like member 3. The traverse wave which reaches at the tip 31 of the rod-like member 3 is further transmitted to the inside of the wing members 4. Stress is applied to the inside of the flexible wing members 4, and the sound proportional to the stress (amplification) is generated, and is emitted.

When the stress is added to the wing members 4, a traverse wave becomes easy to pass through the wing members 4, and the sound proportional to stress (amplification) will be emitted. The phase of sound will not be out of order, and even if the power added to the voice coil 22 is small, the distance at which the sound can reach is long, so that the sound can be heard at a long distance.

There are the following examples of physical phenomena which are similar to that of the speaker in the relation between vibration and sound. When a thin plastic board is pressed on a "music box" which vibrates mechanically, the stress is added to the board, and sound similar to the speaker can be obtained. An electromagnetic wave is measured from the "music box" that vibrates mechanically. In addition, the soliton wave (solitary wave) is also observed.

A string telephone in which paper cups are connected with a thread, may be taken up as another example of the phenomenon. Sound is believed to include a component of a longitudinal wave and a component of a traverse wave. Even if the thread of the string telephone is pressed down by a hand, the sound can be transmitted. It is believed that the component of a traverse wave in the sound propagates in the thread.

If the stress is added to the wing members 4 as mentioned above, it is believed that the force makes a traverse wave of the sound easily pass through between molecules of the wing members 4, so that the sound which is proportional to stress (amplification) is emitted. On the other hand, as the stress added to the wing members 4 is reduced, it becomes difficult for the traverse wave to pass through the inside of the wing member 4, so that the traverse wave is absorbed therein, and the emission of the sound stops. Therefore, in the present speaker 1, the sound can be adjusted from predetermined volume to approximately no sound, or approximately no sound to a predetermined volume.

Figure 5:
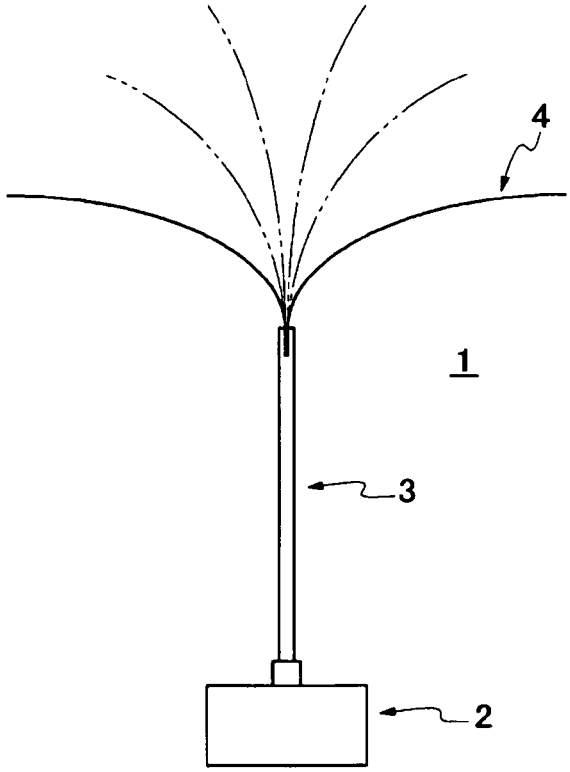
FIG. 5 is a diagram for explaining an operation and effects of a speaker.

As shown in FIG. 5, the volume can be controlled by opening and closing the wing members 4 manually or by a mechanical structure.

The effects of the speaker 1 of the above structure is summarized below. Sounds emitted by the speaker 1 are not affected mutually, and it is constructed so that it is difficult for sounds from the speakers 1 and 1 . . . to interfere with each other. Namely, even if the two or more speakers 1 and 1 are placed and operated in the same sound field (space), it is possible to identify sounds from respective speakers. Therefore, a system different from the conventional system can be designed, without being concerned about the conventional speaker system.

Figure 6:
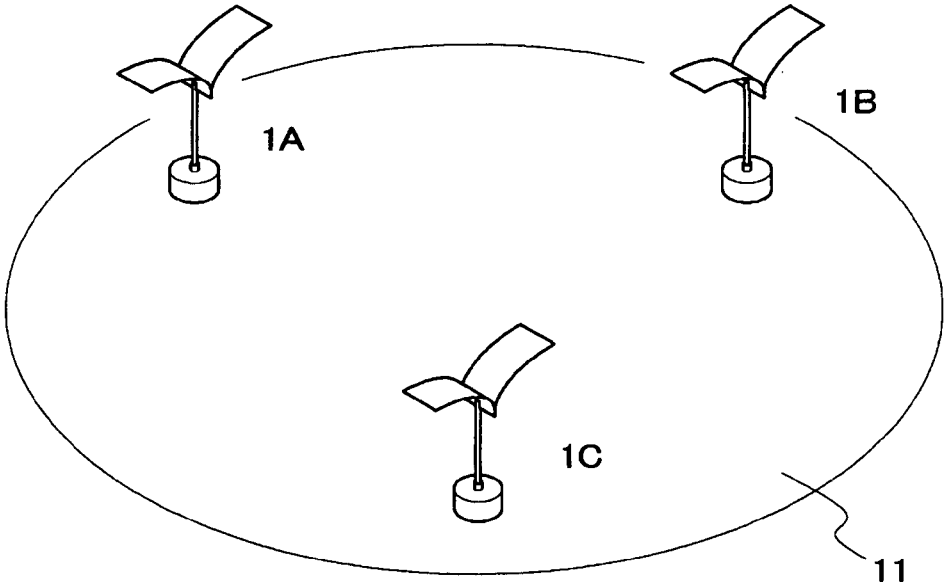
FIG. 6 is a system configuration diagram of a speaker.

For example, as illustrated in FIG. 6, a system for forming a sound field 11 can be configured in which, for example, a sound of "birds' shearing" from a speaker 1A, a sound of "music" from a speaker 1B and a sound of "stream of river" from a speaker 1C can be simultaneously produced. In this system, a listener can recognize each sound clearly, without mixing the sounds from the respective speakers 1A-1C.

By separating the rod-like member 3 from the sound source 2, or bringing it in contact with the sound source 2, touching the rod-like member 3, or making the wing members 4 open and close, not only a child but an adult can experience the relation between vibration and sound therethrough.

A sound can be emitted in directions where the wing members 4 extend by the speaker 1. Therefore, the radiation direction of the sound can be controlled by not only arranging wing members in the direction of 180 degrees about the tip 31 of the rod-like member 3 as the central point, but setting the wing members to an arbitrary angle.

Communications with people can be performed from both hearing sense and visual sense by putting a message into the shape of the wing members 4 or displaying a message on a front and/or back side.

Figure 7:
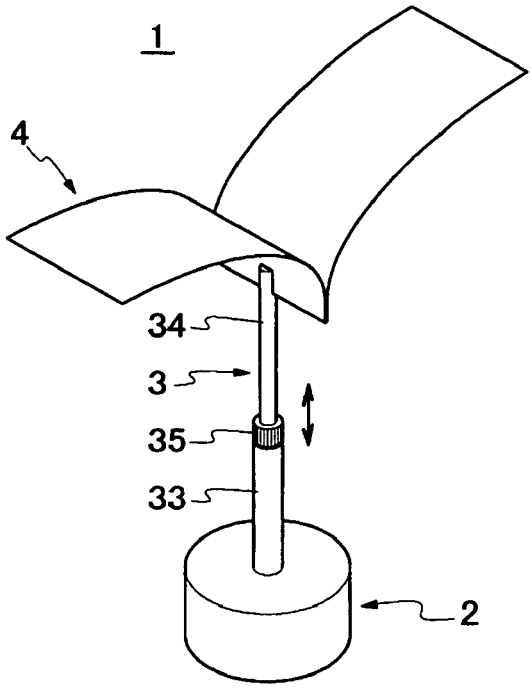
FIG. 7 is a perspective view of a speaker according to a second embodiment.

In addition, as illustrated in FIG. 7, the rod-like member 3 may be divided into two or more parts 33 and 34 and may be telescopically formed through a tightening portion 35. Depending on listeners' positions or the number thereof, the up-and-down position of sound radiation can be adjusted. Other structural elements and effects thereof are the same as those of the speaker 1.

Figure 8:
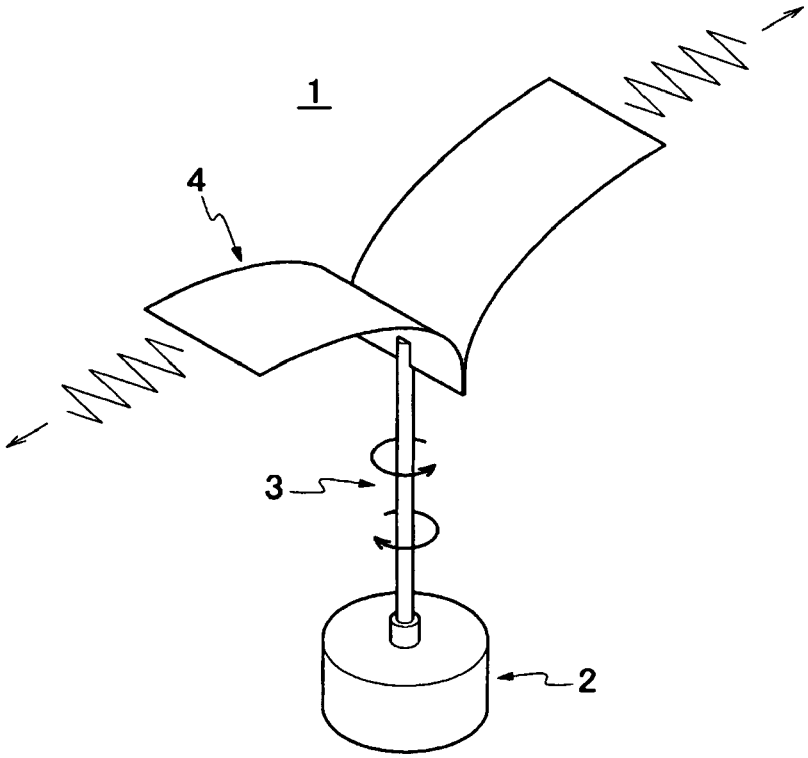
FIG. 8 is a perspective view of a speaker according to a third embodiment.

Next, as illustrated in FIG. 8, the wing members 4 may be rotated. That is, the wing members 4 can be rotated by rotating the rod-like member 3 by a manual operation or automatically. Thus, the speaker is novel in that a sound direction can be rotated at any angle of 360 degrees. According to the structure, in addition to the relation between vibration and sound, a direction of sound can be studied based on experience. Other structural elements and effects thereof are the same as that of the speaker 1.

Figure 9:
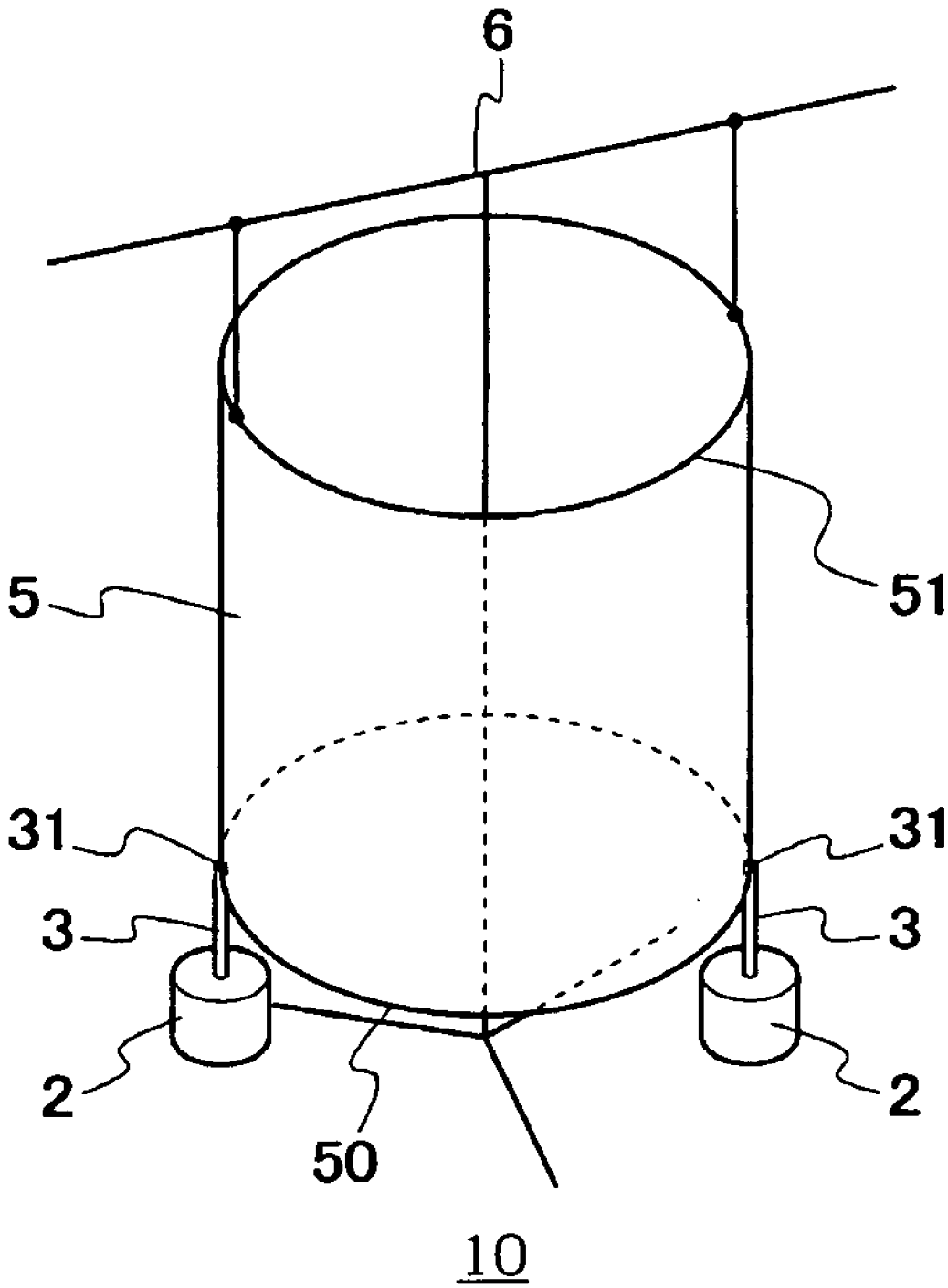
FIG. 9 is a configuration diagram of another example of a speaker.

Based on the knowledge of the new physical phenomena, a speaker system 10 shown in FIG. 9 may be configured as a novel speaker which is different from the conventional speaker. This speaker system 10 has sound sources 2 and 2, rod-like members 3 and 3 whose base ends 30 and 30 are in contact with the respective sound sources 2 and 2 so as to be placed in a stationary state, and in which vibrations from the sound sources 2 and 2 propagate, and a hollow cylinder component 5 whose one end 50 is attached to the respective tips 31 and 31 of the rod-like members 3 and 3, and whose other end 51 is attached to and supported by a stay 6 so that the cylinder is hung therefrom. According to this speaker system 10, the radiation direction of sound can be turned at any angle of approximately 360 degrees around the stay 6 as the center. The material of the cylinder component 5 etc. is approximately the same as the wing members 4 and others structural elements and effects thereof are common to each other.

The preceding description has been presented only to illustrate and describe exemplary embodiments of the present speaker. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A speaker comprising:

a sound source;

a rod-like member whose base end is in contact with the sound source; and a pair of flexible wing members whose ends are attached to a tip of the rod shape member, and whose other ends are free.

2. The speaker according to claim 1, wherein the wing members are detachably provided to the tip of the rod-like member.

3. The speaker according to claim 1, wherein the rod-like member is telescopically provided.

4. The speaker according to claim 1, wherein the wing members is rotatably provided to the speaker.

5. The speaker according to claim 1, wherein the sound source includes a yoke, a permanent magnet, a voice coil to which a signal is inputted, a support section which supports the voice coil in a state where the voice coil is hung in midair, a casing that accommodates the yoke, the permanent magnet, the voice coil, and the support section, a lid which closes an opening of the casing, and a concave portion to which one end of the support member is attached and into which the base end of the rod-like member is inserted.

6. The speaker according to claim 5, wherein the lid is made of synthetic resin.

7. The speaker according to claim 6, wherein the synthetic resin is plastic.

8. The speaker according to claim 5, wherein the lid has a hole into which the concave portion is inserted.

9. The speaker according to claim 5, wherein the concave portion is made from wood, or plastic.

10. The speaker according to claim 5, wherein the lid is directly attached to the casing.

11. The speaker according to claim 1, wherein an insertion slot is formed at the tip of the rod-like member, and ends of the wing members are inserted in the insertion slot.

12. The speaker according to claim 1, wherein the rod-like member is made of wood or bamboo.

13. The speaker according to claim 1, wherein the pair of wing members are spread to right and left, centering on the tip of the rod-like member.

14. The speaker according to claim, 1, wherein the wing members are rectangular, triangular, or circular, respectively.

15. The speaker according to claim 1, wherein each of the wing members is made from paper sheet, synthetic resin, or styrene foam.

16. The speaker according to claim 1, wherein concavo-convex emboss patter is formed a front face and/or a back face of the wing members.

17. The speaker according to claim 1, wherein the wing members are made from one paper sheet.

18. A method of producing a sound from the speaker according to claim 1, the method comprising the following steps of:

inputting a signal to a voice coil;

vibrating a lid by kinetic force generated by the signal inputted to the voice coil;

propagating a traverse wave in the rod-like member which is connected to the lid;

transmitting the traverse wave into at least one of the pair of flexible wing members, whereby a sound is emitted from at least one of the pair of flexible wing members.

19. The method according to claim 18, further including a step of rotating at least one of the pair of flexible wing members so as to change a direction of the sound.

20. The method according to claim 18, further including a step of increasing or decreasing stress of at least one of the pair of flexible wing members so as to control a volume of the sound.

21. The method according to claim 20, wherein the stress is increased or decreased by opening or closing at least one of the pair of flexible wing members.

22. The method according to claim 18, further including a step of moving at least one of the pair of flexible wing members up-and-down directions.

23. A speaker system comprising two or more of the speakers according to claim 1.

* * * * *